United States Patent [19]

Hicks

[11] Patent Number: 4,887,748

[45] Date of Patent: Dec. 19, 1989

[54] APPARATUS AND METHOD FOR ATTACHMENT OF SUBMERGED NOZZLE TO LOWER PLATE OF SLIDING GATE VALVE MECHANISM FOR A CONTINUOUS CASTING OPERATION

[75] Inventor: James W. Hicks, St. John, Ind.

[73] Assignee: J. W. Hicks, Inc., St. John, Ind.

[21] Appl. No.: 947,399

[22] Filed: Dec. 29, 1986

[51] Int. Cl.[4] ..... B22D 41/00

[52] U.S. Cl. ..... 222/606; 222/591

[58] Field of Search ..... 222/600, 606, 591, 598, 222/590; 266/236, 271; 285/396; 164/337, 437

[56] References Cited

U.S. PATENT DOCUMENTS

| | | | |
|---|---|---|---|
| 2,283,672 | 5/1942 | Frances | 285/396 X |
| 3,478,302 | 11/1969 | Chirumbolo | 285/396 X |
| 3,727,805 | 4/1973 | Shapland | 222/606 X |
| 4,063,668 | 12/1977 | Shapland et al. | 222/512 |
| 4,182,466 | 1/1980 | Fehling et al. | 222/600 |
| 4,199,087 | 4/1980 | Goles et al. | 222/603 |
| 4,316,561 | 2/1982 | Grosko | 222/606 |
| 4,480,770 | 11/1984 | Goursat et al. | 222/600 X |
| 4,480,771 | 11/1984 | Meier | 222/598 |

*Primary Examiner*—Kevin P. Shaver

*Assistant Examiner*—Gregory L. Huson

*Attorney, Agent, or Firm*—Woodard, Emhardt, Naughton Moriarty & McNett

[57] ABSTRACT

An apparatus and method for attaching the submerged nozzle to the lower plate of a sliding gate valve mechanism in a system in which such an assembly is replaceable during a continuous casting operation is disclosed in which the coupling of the lower plate to the submerged nozzle is achieved by way of a bayonet-type attachment between a lower plate container and a submerged nozzle retainer that is uniformly adjustable during operation. The assembly is first tightened snugly in a pre-operative condition, then loaded into an operative position where, after thermal and mechanical forces have acted on the assembly, it is adjusted into a fully tightened operational condition. At all times when the assembly is in (1) the pre-operative snug condition, (2) the operating fully tightened position, and (3) the full range of positions in between, handles are positioned wholely under the lower plate container, whereby unobstructed replacement and adjustment can take place. Additionally, argon is introduced into an annular pocket within the submerged nozzle retainer and around the joint to cool the relative components and serve to buffer the sealed joint from atmospheric gases.

7 Claims, 4 Drawing Sheets

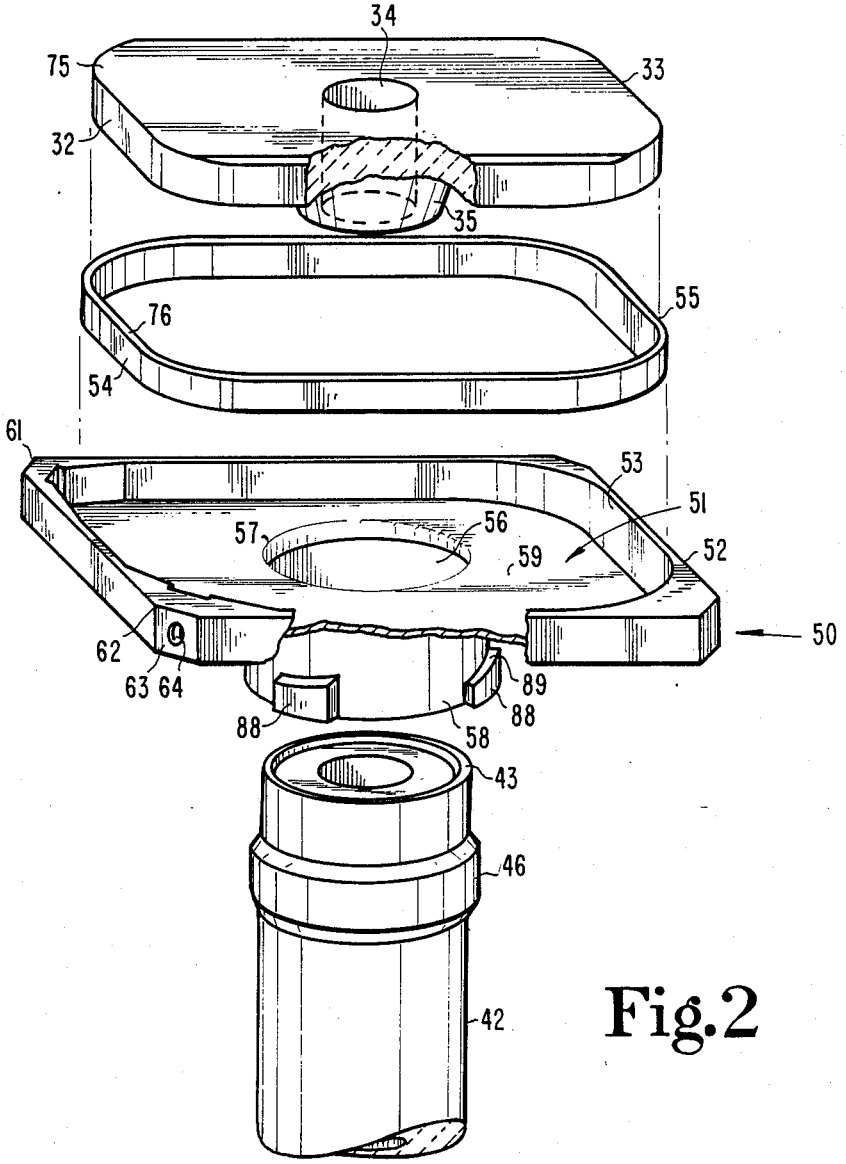
Fig.2
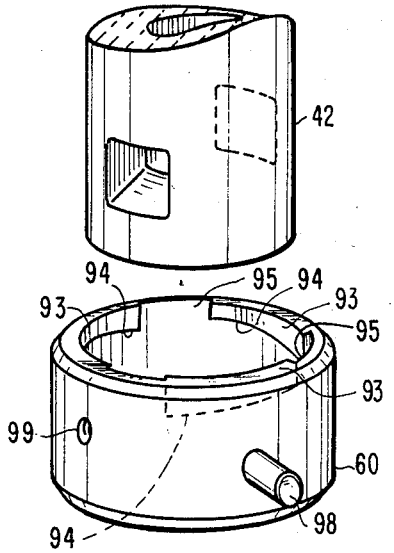

APPARATUS AND METHOD FOR ATTACHMENT OF SUBMERGED NOZZLE TO LOWER PLATE OF SLIDING GATE VALVE MECHANISM FOR A CONTINUOUS CASTING OPERATION

FIELD OF THE INVENTION

The present invention relates to the field of continuous casting of molten metals, and in particular it relates to apparatus and methods for attaching the submerged nozzle to the lower plate of a sliding gate valve mechanism where the lower plate is replaceable during a continuous casting operation.

BACKGROUND OF THE INVENTION

In a continuous casting operation, molten metal is throttled through a valving system from a tundish and into and open-ended mold. The steel, which has solidified on its surface but remains liquid inside, is withdrawn from the mold at ideally the same rate at which it is being throttled though the valving mechanism. Several well known valve systems have been devised to throttle the flow of molten metal in a continuous casting process. One such system in common use today is described in U.S. Pat. Nos. 4,063,668 and 4,199,087.

Since the refractory parts of such valve systems are being constantly exposed to molten metal, these parts deteriorate and need to be replaced. The periodic replacement of these wear parts necessitated by their deteriorations thus presents itself as a limiting factor in the length of continuous operation and operating efficiency of these systems. The system described in the above patents presents an advantage over other systems in that both the lower plate as well as the throttling plate are replaceable in the course of a continuous casting operation, thus extending the time in which the operation may continue uninterrupted and improving the efficiency of operation.

While the above mentioned system extends the period of continuous operation by eliminating the throttling plate, the lower plate, and the submerged nozzle as the limiting wear factors, a secondary limiting factor has arisen which the present invention is intended to also alleviate. That limitation concerns the joint between the lower plate and the submerged nozzle which introduces the metal into the open-ended mold.

In the above mentioned system, bolts attach the lower plate of the valving mechanism to the submerged nozzle. As these components are assembled prior to being inserted into an operating slide gate assembly, the relative tightness of the connection will invariably change since the lower plate, the nozzle and the attaching bolts all have differing thermal expansion characteristics. No matter how tightly or loosely the lower plate is sealed against the nozzle in pre-assembly, the temperatures of operation will cause uneven expansion between the metal bolts and the refractory plate with undesirable attendant results. Excessive expansion of the bolts can cause a loss of the sealing relationship between the lower valve plate and the nozzle. This loss of a sealing relationship allows atmospheric gases to enter into the molten stream, thus causing undesirable impurities in the finished product. On the other hand, if the bolts are initially tightened too tightly to account for the relative expansion, the refractory components are subject to cracking, which also has the effect of allowing atmospheric gases to enter the molten stream and, more critically, may result in a complete break-up of the refractory parts and an uncontrolled spillage of molten metal. Access to the bolts for adjustment during operation is difficult and dangerous since the operation must come in close proximity to the stream of molten steel. Moreover, precise uniform adjustment required of the several attachment bolts to avoid uneven stress concentrations is virtually impossible to obtain under operating conditions. It is to be further noted that these changes occurring at this joint are also effecting the rate of flow of the molten metal through the valving system, thus making the ultimate task of continuous casting more difficult.

U.S. Pat. No. 4,199,087 partially recognizes this problem and attempts to alleviate it by injecting an inert gas into the molten stream at the joint between the lower plate and the submerged nozzle. This presented solution is inadequate in that it fails to address the variation of conditions acting upon the joint in question which may cause cracking and/or leaking in spite of this suggested stop-gap measure.

SUMMARY OF THE INVENTION

By the present invention, there is provided an apparatus and method for attaching the submerged nozzle to the lower plate of a sliding gate valve mechanism in a system in which such an assembly is replaceable during a continuous casting operation. In one embodiment, the coupling of the lower plate to the submerged nozzle is achieved by way of a bayonet-type attachment between a lower plate container and a submerged nozzle retainer that is uniformly adjustable during operation. The assembly is first tightened snugly in a pre-operative condition, then loaded into an operative position where, after thermal and mechanical forces have acted on the assembly, it is then tightened into a fully tightened operational condition. At all times when the assembly is in (1) the pre-operative snug condition, (2) the operating fully tightened position, and (3) the full range of positions in between, handle means are positioned wholely under the lower plate container, whereby unobstructed replacement and adjustment can take place. Additionally, argon is introduced into an annular pocket within the submerged nozzle retainer and around the joint to cool the relative components and serve to buffer the sealed joint from atmospheric gases.

Accordingly, it is one object of the present invention to provide a safe manner of mounting, changing and adjusting the refractory components of the throttling mechanism of a continuous casting apparatus to accommodate relative changes in the components due to thermal expansion and other acting forces.

It is a further object of the present invention to provide a better, longer lasting, seal between the lower plate and the submerge nozzle.

It is yet a further object to facilitate the control of the rate of flow of molten metal by preventing the introduction of atmospheric gases into the stream and by preventing other undesirable conditions such as cracking and/or leaking.

Other objects and advantages will become apparent from the following description and claims.

BRIEF DESCRIPTION OF THE DRAWINGS

FIG. 2 is an exploded perspective, partially sectioned view of the lower plate/submerged nozzle coupling of FIG. 1.

DESCRIPTION OF THE PREFERRED EMBODIMENT

Figure 1:
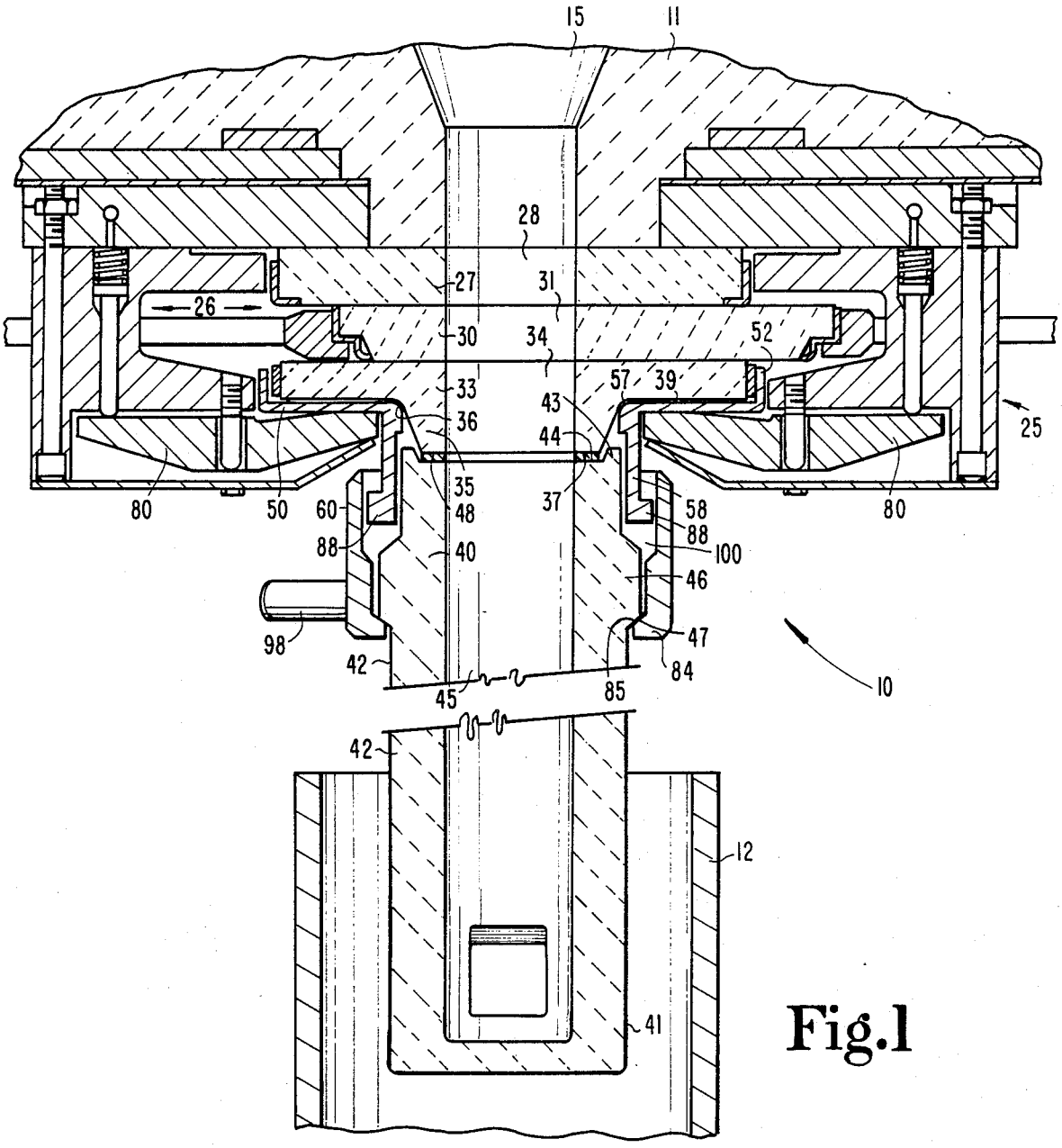
FIG. 1 is a front cross-sectional view of portions of a continuous casting operation incorporating a coupling between the lower plate and the submerged nozzle according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, there is shown portions of a continuous casting operation 10 which functions to throttle the rate of flow of molten metal from tundish 11 to open-ended mold 12. The flow of molten metal out of tundish 11 through opening 15 is regulated by sliding gate valve system 25 which includes upper plate 27, throttling plate 30, and lower plate 33. A sliding gate valve system of the type for which the present invention is intended is disclosed in U.S. Pat. No. 4,063,668 and is hereby incorporated by reference. Refractory plates 27, 30 and 33 have central apertures 28, 31, and 34, respectively, which are alignable with opening 15 to permit free flow of molten metal out of tundish 11. Throttling plate 30 is laterally slidable relative to upper plate 27 and lower plate 33 in the lateral direction of arrows 26, whereby the alignment between aperture 31 and apertures 28 and 34 can be altered to control the rate of flow of molten metal through sliding gate valve system 25.

Located directly below and adjacent to the bottom of lower plate 33, is upper portion 40 of submerged nozzle 42. Nozzle 42 defines central passage 45 which is aligned and in mutual communication with apertures 34, 31, 28 and 15 to deliver molten metal into mold 12 at lower portion 41 of nozzle 42 which is positioned within mold 12. Each of the components which are to be exposed to the molten metal (upper plate 27, throttling plate 30, lower plate 33 and nozzle 42) are composed of suitable refractory material, such as alumina graphite or alumina carbon.

Two sets of support fingers 80 support lower plate container 50 in an operative position within sliding gate valve system 25. As has been mentioned, lower plate 33 is replaceable in the course of a continuous casting operation. This is generally accomplished by pushing a replacement plate into position (in a direction into the cross-section of FIG. 1) while pushing the worn, operating plate out. For a more particular description, reference is made to U.S. Pat. No. 4,063,668. The significance of the operative replacement sequence in relation to the present invention will be later discussed in conjunction with the FIG. 6.

The manner in which lower plate 33 is contained within lower plate container 50 will be now be described. Lower plate container 50 (FIGS. 1, 2 and 3) is a unitary cast steel container having sidewalls 52 which define a central recess 51. Steel band 55, having a thickness of approximately 3.2 mm, contiguously encircles the outer edge 32 of refractory lower plate 33 and is applied thereto by a thermal shrink fit. Lower plate 33 and steel band 55 fit snugly within the recess 51 of lower plate container 50 with outer surface 54 of steel band 55, being substantially contiguous with the inner surface 53 of walls 52. The relative dimensions of lower plate 33, band 55, and sidewalls 52 are such that when lower plate 33 and steel band 55 are firmly in place in container 50, top surface 75 of plate 33 is at all points above steel band 55 while top edge 76 of steel band 55 is at all points above walls 52 of lower plate container 50. Leading and trailing edges 68 and 69 of lower plate 33 are beveled to facilitate the loading and unloading of the lower plate/submerged nozzle assembly.

Figure 3:
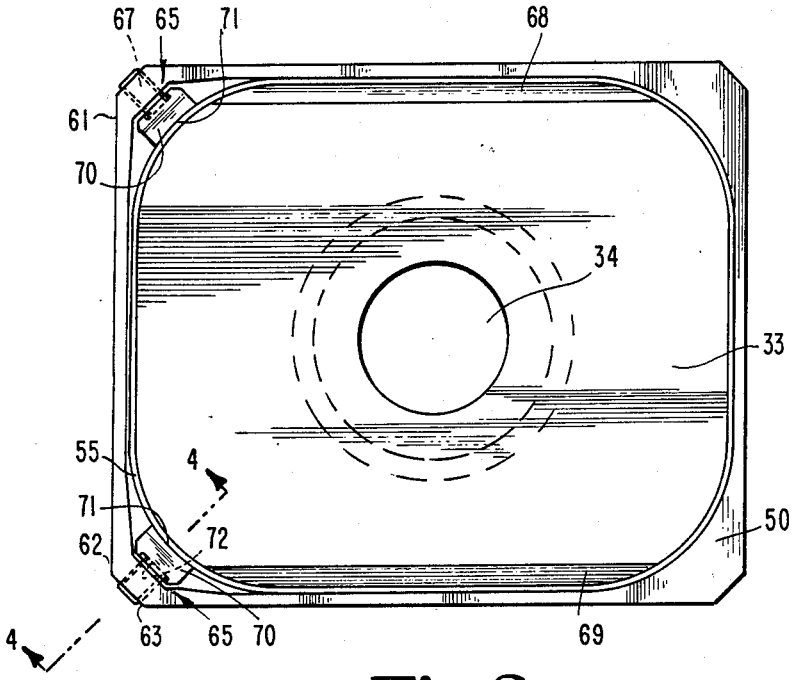
FIG. 3 is a top view of the lower plate and lower plate container assembly of FIGS. 1 and 2.
Figure 4:
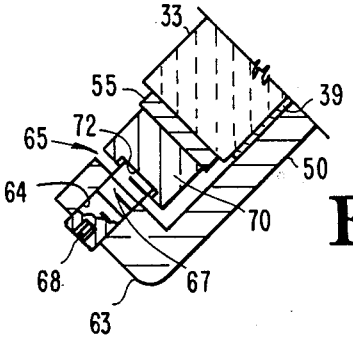
FIG. 4 is a section view of the set screws along the lines 4—4 of FIG. 3.
Figure 5:
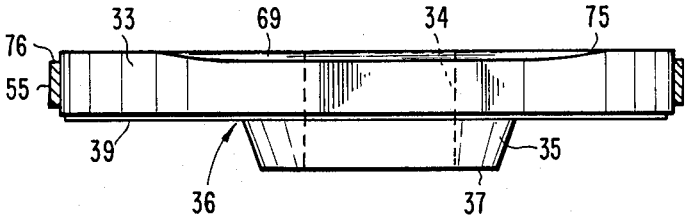
FIG. 5 is a view of the bottom refractory plate with the steel band in cross-section.

The inner surfaces of two adjacent corners 61 and 62 are recessed slightly to accommodate a pair of set screw assemblies 65 (FIGS. 3 and 4). Each corner 61 and 62 is beveled to create a flattened surface 63 being 45 degrees to each adjacent sidewall. Extending through each corner 61 and 62 is an internally threaded hole 64. A half dog point, hex head, set screw 67 is received in meshing engagement within hole 64. Disposed within the recess of each corner 61 and 62, between screw 67 and steel band 55, is clamping head 70 having an arcuate surface 71 contoured to rest contiguously with the outer surface of band 55. Recess 72 in the side of head 70, opposite arcuate surface 71, receives an end of screw 67 to keep clamping head 70 aligned within its respective corner. Set screw assemblies 61 are tightened uniformly to fix lower plate 33 in place within lower plate container 50.

Steel band 55 serves several purposes. One, it uniformly distributes the forces exerted upon lower plate 33 by set screw assemblies 65 to avoid cracking the more brittle refractory material of lower plate 33. It also adds hot strength to lower plate 33. Finally, if lower plate 33 does crack during operation, steel band 55 keeps plate 33 together until the assembly can be changed.

Cylindrical extension 58 of lower plate container 50 extends downwardly to define a central passage 56 to receive and guide together in mating relationship annular conical downwardly extending portions 35 of lower plate 33 and upwardly extending portion 40 of nozzle 42. Interior rim 57 of plate container 50, created by the inner surface of cylindrical extension 58 and floor 59, is rounded, as is throat 36 of annular conical downwardly extending portion 35, to reduce the stress concentrations within lower plate 33 and between lower plate 33 and lower plate container 50. The thickness of rim 57 of lower plate container 50 is greater than the thickness of the rest of container 50 to improve the torsional rigidity. The slope of the annular conical downwardly extending portion 35 is approximately 34 degrees to vertical. Annular cushion sheet 39, about 1.5 mm thick and made of ceramic paper or a combination of ceramic paper and sheet metal, is disposed between the annular bottom surface 38 of lower plate 33 and lower plate container 50. Sheet 39 cushions lower plate 33 from any irregularities in floor 59 which might crack the brittle, refractory lower plate 33. Annular conical downwardly extending portion 35 defines, at its bottom, flat annular surface 37d. Mating flat annular surface 44 is defined by the top of upper portion 40 of nozzle 42 and by upstanding annular flange 43. Annular flange 43 is also sloped, at its inside surface, at approximately 34 degrees and serves to guide surfaces 37 and 44 together causing central aperture 34 of lower plate 33 to be aligned and in communication with central passage 45 of nozzle 42. Gasket 48, which may be made of refractory alumina, ceramic fiber, or other high temperature compressible material, is disposed between surfaces 37 and 44 to cushion the surfaces from the extremely high compressive forces exerted on them and to seal the joint between these surfaces.

Nozzle 42 is contained within submerged nozzle retainer 60 in the following manner. Upper portion 40 of nozzle 42 has an outwardly extending annular shoulder 46, the bottom edge 47 of which forms an angle of approximately 60 degrees to the central axis of nozzle 42. Submerged nozzle retainer 60 includes, at its bottom, an inwardly extending annular flange 84, the top surface 85 of which also forms an angle of approximately 60 degrees to the central axis of retainer 60. The minimum interior diameter of submerged nozzle retainer 60 is defined by the interior diameter of the annular flange 84. The diameter of nozzle 42, at all points below the annular-shoulder 46, is less than the interior diameter of the flange 84. Nozzle 42 may thus be passed into submerged nozzle retainer 60 until lower annular surface 47 of shoulder 46 comes in contact with upper annular surface 85 of flange 84. The relative angles of surfaces 84 and 85 are such that a common normal is shared at every point of contact between surfaces 47 and 85. The coefficient of friction between nozzle 42 and retainer 60 being lower than the coefficient of friction between nozzle 42 and gasket 48, nozzle 42 does not turn when submerged nozzle retainer 60 is tightened in operation. This is important to maintain the relative position of nozzle 42 within mold 12. To ensure this relationship, a graphite powder may be applied to surfaces 47 and/or 85 prior to assembly.

Nozzle 42 is held in compressive relation with lower plate 33 by means of a coupling assembly as will now be described, and involved a bayonet-type coupling between submerged nozzle retainer 60 and cylindrical extension 58 of lower plate container 50. For securing submerged nozzle retainer 60 to cylindrical extension 58 of lower plate container 50, a set of three outwardly extending ramps 88 are spaced equidistantly around the circumference and at the bottom of cylindrical extension 58. Each ramp extends circumferentially approximately 36 degrees with a space of approximately 84 degrees between each ramp. Looking downward on lower plate container 50, top surface 89 of each ramp slopes upward in a counter-clockwise direction. A set of three mating ramps 93 extends inwardly from submerged nozzle retainer 60. Each ramp 93 extends circumferentially approximately 80 degrees around the interior surface of submerged nozzle retainer 60 leaving gaps 95 of approximately 40 degrees between each adjacent set of ramps 93. Looking from the top of submerged nozzle retainer 60, bottom surface 94 of each ramp 93 slopes downward in the clockwise direction. The slope of each ramp 93 has the same pitch as the slope of each ramp 88, that pitch being 0.775 mm of rise for each 10 degrees of rotation. With submerged nozzle retainer 60 encircling nozzle 42 and with sloped surface 47 in contiguous contact with sloped surface 85, the combination of submerged nozzle retainer 60 and nozzle 42 is securable to lower plate container 50 by sliding submerged nozzle retainer 60 upwards and over the outside of cylindrical extension 58 with ramps 88 passing through gaps 95, there being approximately 2 degrees of clearance between each ramp 88 and each ramp 93. Rotating the submerged nozzle retainer 60 slightly counter-clockwise (looking downwardly), when ramps 93 pass over ramp 88, submerged nozzle retainer 60 may then be further rotated in a counter-clockwise direction to complete the engagement. Further rotation lifts submerged nozzle retainer 60 and thus nozzle 42 upwards until top surface 44 of nozzle 42 comes in contact and compresses gasket 48 against bottom surface 37 of lower plate 33. The relative dimensions of ramps 88 and 93 and of bayonet 60, nozzle 42 and bottom plate 33 are such that when all components shown in FIG. 1 are tightly adjacent one another, ramp 88 rests substantially centered relative to ramps 93.

Rotation of submerged nozzle retainer 60 is facilitated by a pair of diametrically opposed, outwardly extending handles 98. Prior to loading, retainer 60 is to be snugly attached by manually turning handles 98. During operation, adjustment may be remotely accomplished by sliding the end of a pipe over either of two handles 98. Thus an operator may safely and accurately adjust the compression at the critical joint between lower plate 35 and nozzle 42 to compensate for changes that have occurred due to thermal expansion and other acting mechanical forces. The coupling assembly heretofore described further insures uniform compression of nozzle 42 against lower plate 35 at all times, thus providing an added measure of safety and insurance against leaks or cracks.

Figure 6:
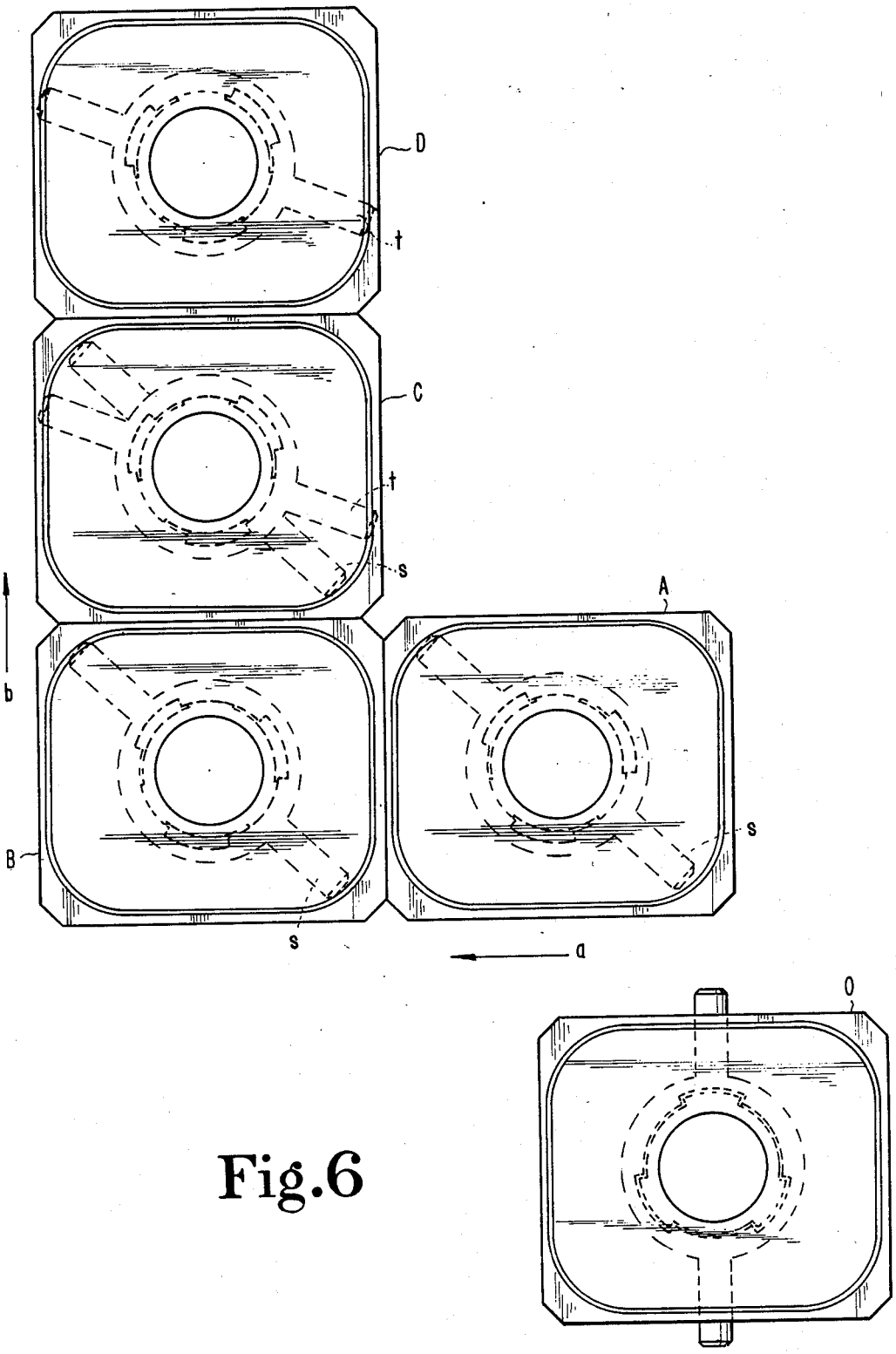
FIG. 6 is a top plane view showing the operational sequence of lower plate/submerged nozzle assemblies.

FIG. 6 illustrates the operational sequence of lower plate/submerged nozzle assemblies. Assembly O shows the relative positioning of handles 98 prior to engagement of ramps 88 and 93. Assembly A is in a pre-assembled, preloaded state. Assembly A is then moved in the direction of arrow a into a loading position illustrated by assembly B. When a change of assemblies is indicated, assembly B is then pushed in the direction of arrow b against assembly C and into the operative position illustrated by assembly C. The insertion of assembly B into operative position replaced assembly C by pushing assembly C out of operative position and into a discharged position (assembly D).

It is important to note the relative positions of handles 98 during the operational sequence illustrated in FIG. 6. In pre-assembled, preloaded assembly A, handles 98 have been snugly tightened to position s. After being loaded into an operative position (assembly C), handles 98 are further tightened from position s to position t. It is critical that in neither position s, position t, nor the range of positions between positions s and t, do handles 98 extend beyond either the leading edge 1 or the trailing edge r of container 50. Should handles 98 extend beyond the sides of container 50 (as shown in assembly O), then adjacent assemblies may obstruct each other during loading and/or tightening. Such an occurrence would render the replacement sequence inoperational at best, and may result in a disasterous accident with molten metal being uncontrollably spilled about the operation area.

It is to be observed that the actual position of handles 98 can not be precisely predicted and will vary depending upon a variety of factors. Of course, positioning will individually vary depending upon the individual conditions acting upon the assembly. Other factors, though, such as the thickness and compressibility of gasket 48, the distance from surface 37 to edge 47 of nozzle 42, the length and relative positioning of handles 98, and the slope of ramps 88 and 93 will effect the overall range to be expected and allowed from the snugly tightened, preloaded position s to the operationally tightened position t.

It is anticipated that the ramp configuration as disclosed herein will permit a range of tightening from position s to position t of 0° to about 40°. Accordingly, the parameters of gasket 48 and nozzle 42 should be selected to accommodate this range of tightening where handles 98 do not extend beyond the sidewalls of container 50, thus permitting the unobstructed changing of the lower plate/submerged nozzle assembly during the continuous casting operation. That is, with a coupling assembly in place in an operating position, a new coupling assembly may be loaded, discharging the old coupling assembly, there being no contact between components of the exiting and entering assemblies other than the leading and trailing edges of lower plate container 50.

What is claimed is:

1. A method for attaching a submerged nozzle to an operationally replaceable lower plate of a sliding gate valve system for a continuous casting operation, said method comprising:

placing a lower plate in a lower plate container having a downwardly extending cylindrical portion, the lower plate container further having a plurality of lower plate attachment means extending radially from the downwardly extending cylindrical portion, the plurality of lower plate attachment means being approximately equidistantly disposed about the downwardly extending cylindrical portion;

placing a submerged nozzle within a submerged nozzle retainer having an upwardly extending cylindrical portion, the lower plate and the submerged nozzle collectively defining an operator adjustable seal therebetween, the nozzle retainer being angularly movable independent of the lower plate and independent of the submerged nozzle during continuous casting operations of the molten metal, the submerged nozzle retainer further having a plurality of nozzle attachment means extending radially from the upwardly extending cylindrical portion, the plurality of attachment means being approximately equidistantly disposed about the upwardly extending cylindrical portion and being configured for cooperative engagement with said lower plate attachment means, the cooperative engagement being such that relative angular movement in one direction uniformly tightens the operator adjustable seal between the lower plate and the submerged nozzle and in the opposite direction uniformly loosens the seal between the lower plate and the submerged nozzle to allow selective operator adjustment of the tightness of said seal during continuous casting operations of molten metal; the submerged nozzle retainer further having handle means extending outwardly radially from the upwardly extending portion of said nozzle retainer for remote relative adjustment during operation;

pre-assembling the submerged nozzle retainer to the lower plate container by engagement of the submerged nozzle retainer attachment means to the lower plate container attachment means to construct a snugly configured lower plate/submerged nozzle assembly;

placing the snugly configured lower plate/submerged nozzle assembly in an operative position in a sliding gate valve system;

waiting for thermal and mechanical effects to act upon the lower plate/submerged nozzle assembly caused by continuous casting of molten metal; and tightening the lower plate/submerged nozzle assembly during continuous casting operations of molten metal by remotely turning the handle means of the submerged nozzle retainer relative to the lower plate container while maintaining the submerged nozzle in the same relative position with respect to the lower plate container.

2. The method of claim 1 in which the lower plate container has a first leading edge defining a leading edge vertical plane, and a second trailing edge defining a trailing edge vertical plane, and in which said said pre-assembling step includes the step of positioning the handle means wholely between the leading vertical plane and the trailing edge vertical plane (position s); and in which said tightening step includes the step of moving the handle means to a second position in which the handle means are also wholely between the leading vertical plane and the trailing edge vertical plane (position t); and where handle means are wholely between the leading vertical plane and the trailing edge vertical plane in the full range of positions between position s and position t.

3. The method of claim 1 additionally including the step of injecting an inert gas into an annular pocket within the submerged nozzle retainer and about the joint between the lower plate and the submerged nozzle.

4. A coupling assembly for attaching a submerged nozzle to an operationally replaceable lower plate of a sliding gate valve system for a continuous casting operation, said coupling assembly comprising:

a lower plate container defining a central recess for receiving a lower plate, and including a downwardly extending cylindrical portion, said lower plate container further including a plurality of lower plate attachment means extending radially from said downwardly extending cylindrical portion, said plurality of lower plate attachment means being approximately equidistantly disposed about said downwardly extending cylindrical portion;

a submerged nozzle retainer defining a central recess for receiving a submerged nozzle, and including an upwardly extending cylindrical portion, said submerged nozzle retainer further including a plurality of nozzle attachment means extending radially from said upwardly extending cylindrical portion, said plurality of attachment means being approximately equidistantly disposed about said upwardly extending cylindrical portion and being configured for cooperative engagement with said lower plate attachment means, the cooperative engagement being such that relative angular movement in one direction uniformly tightens the seal between the lower plate and the submerged nozzle and in the opposite direction uniformly loosens the seal between the lower plate and the submerged nozzle;

handle means extending outwardly radially from said upwardly extending portion of said nozzle retainer for remote relative adjustment during operation;

submerged nozzle position maintaining means for maintaining the submerged nozzle in the same relative position with respect to said lower plate container when said submerged nozzle retainer is angularly moved relative to said lower plate container during operation;

an annular gasket of refractory material disposed between the nozzle and the lower plate, wherein said submerged nozzle position maintaining means includes means for providing that the coefficient of friction between the nozzle and said nozzle retainer is less than the coefficient of friction between the submerged nozzle and said gasket during operation, whereby the submerged nozzle is maintained in the same relative configuration during operational adjustment, wherein said submerged nozzle position maintaining means includes an application of graphite powder between said submerged nozzle retainer and the submerged nozzle.

5. An operationally replaceable lower plate/submerged nozzle assembly for a continuous casting sliding gate valve system, said assembly comprising:

a refractory lower plate;

a lower plate container defining a central recess for receiving said lower plate, and including a downwardly extending cylindrical portion, said lower plate container further including a plurality of lower plate attachment means extending radially from said downwardly extending cylindrical portion, said plurality of lower plate attachment means being approximately equidistantly disposed about said downwardly extending cylindrical portion;

a submerged nozzle;

a submerged nozzle retainer defining a central recess for receiving said submerged nozzle, and including an upwardly extending cylindrical portion, said submerged nozzle retainer further including a plurality of nozzle attachment means extending radially from said upwardly extending cylindrical portion, said plurality of attachment means being approximately equidistantly disposed about said upwardly extending cylindrical portion and being configured for cooperative engagement with said lower plate attachment means, the cooperative engagement being such that relative angular movement in one direction uniformly tightens the seal between said lower plate and said submerged nozzle and in the opposite direction uniformly loosens the seal between the lower plate and the submerged nozzle;

handle means extending outwardly radially from said upwardly extending portion of said nozzle retainer for remote relative adjustment during operation;

submerged nozzle position maintaining means for maintaining said submerged nozzle in the same relative position with respect to said lower plate container when said submerged nozzle retainer is angularly moved relative to said lower plate container during operation;

an annular gasket of refractory material disposed between said nozzle and said lower plate, wherein said submerged nozzle position maintaining means includes means for providing that the coefficient of friction between said nozzle and said nozzle retainer is less than the coefficient of friction between said submerged nozzle and said gasket during operation, whereby the submerged nozzle is maintained in the same relative configuration during operational adjustment, wherein said submerged nozzle position maintaining means includes an application of graphite powder between said submerged nozzle retainer and said submerged nozzle.

6. A coupling assembly for attaching a submerged nozzle to an operationally replaceable lower plate of a sliding gate valve system for a continuous casting operation, said coupling assembly comprising:

a lower plate container defining a central recess for receiving a lower plate, and including a downwardly extending cylindrical portion, said lower plate container further including a plurality of lower plate attachment means extending radially from said downwardly extending cylindrical portion, said plurality of lower plate attachment means being approximately equidistantly disposed about said downwardly extending cylindrical portion;

a submerged nozzle retainer defining a central recess for receiving a submerged nozzle, and including an upwardly extending cylindrical portion, said submerged nozzle retainer further including a plurality of nozzle attachment means extending radially from said upwardly extending cylindrical portion, said plurality of attachment means being approximately equidistantly disposed about said upwardly extending cylindrical portion and being configured for cooperative engagement with said lower plate attachment means, the cooperative engagement being such that relative angular movement in one direction uniformly tightens the seal between the lower plate and the submerged nozzle and in the opposite direction uniformly loosens the seal between the lower plate and the submerged nozzle;

handle means extending outwardly radially from said upwardly extending portion of said nozzle retainer for remote relative adjustment during operation;

submerged nozzle position maintaining means for maintaining the submerged nozzle in the same relative position with respect to said lower plate container when said submerged nozzle retainer is angularly moved relative to said lower plate container during operation;

an annular gasket of refractory material disposed between the nozzle and the lower plate, wherein said submerged nozzle position maintaining means includes means for providing that the coefficient of friction between the nozzle and said nozzle retainer is less than the coefficient of friction between the submerged nozzle and said gasket during operation, whereby the submerged nozzle is maintained in the same relative configuration during operational adjustment, wherein said submerged nozzle position maintaining means includes an application of a lubricant between said submerged nozzle retainer and the submerged nozzle.

7. An operationally replaceable lower plate/submerged nozzle assembly for a continuous casting sliding gate valve system, said assembly comprising:

a refractory lower plate;

a lower plate container defining a central recess for receiving said lower plate, and including a downwardly extending cylindrical portion, said lower plate container further including a plurality of lower plate attachment means extending radially from said downwardly extending cylindrical portion, said plurality of lower plate attachment means being approximately equidistantly disposed about said downwardly extending cylindrical portion;

a submerged nozzle;

a submerged nozzle retainer defining a central recess for receiving said submerged nozzle, and including an upwardly extending cylindrical portion, said submerged nozzle retainer further including a plurality of nozzle attachment means extending radially from said upwardly extending cylindrical portion, said plurality of attachment means being approximately equidistantly disposed about said upwardly extending cylindrical portion and being configured for cooperative engagement with said lower plate attachment means, the cooperative engagement being such that relative angular movement in one direction uniformly tightens the seal between said lower plate and said submerged nozzle and in the opposite direction uniformly loosens the seal between the lower plate and the submerged nozzle;

handle means extending outwardly radially from said upwardly extending portion of said nozzle retainer for remote relative adjustment during operation;

submerged nozzle position maintaining means for maintaining said submerged nozzle in the same relative position with respect to said lower plate container when said submerged nozzle retainer is angularly moved relative to said lower plate container during operation;

an annular gasket of refractory material disposed between said nozzle and said lower plate, wherein said submerged nozzle position maintaining means includes means for providing that the coefficient of friction between said nozzle and said nozzle retainer is less than the coefficient of friction between said submerged nozzle and said gasket during operation, whereby the submerged nozzle is maintained in the same relative configuration during operational adjustment, wherein said submerged nozzle position maintaining means includes an application of a lubricant between said submerged nozzle retainer and said submerged nozzle.

* * * * *